US011136787B2

(12) United States Patent
Lai

(10) Patent No.: US 11,136,787 B2
(45) Date of Patent: Oct. 5, 2021

(54) RETRACTABLE CABLE LOCK WITH IMPROVED RESET MECHANISM

(71) Applicant: THE SUN LOCK INTERNATIONAL COMPANY LIMITED, Tuen Mun (HK)

(72) Inventor: Karl Lai, Tai Po (HK)

(73) Assignee: THE SUN LOCK INTERNATIONAL COMPANY LIMITED, Tuen Mun (HK)

( * ) Notice: Subject to any disclaimer, the term of this patent is extended or adjusted under 35 U.S.C. 154(b) by 282 days.

(21) Appl. No.: 16/438,680

(22) Filed: Jun. 12, 2019

(65) Prior Publication Data

US 2020/0217103 A1 Jul. 9, 2020

Related U.S. Application Data

(60) Provisional application No. 62/791,206, filed on Jan. 11, 2019, provisional application No. 62/788,358, filed on Jan. 4, 2019.

(51) Int. Cl.

| | |
|---|---|
| ***E05B 37/02*** | (2006.01) |
| ***E05B 73/00*** | (2006.01) |
| ***E05B 37/00*** | (2006.01) |

(52) U.S. Cl.

CPC ..... *E05B 37/025* (2013.01); *E05B 37/0058* (2013.01); *E05B 37/0068* (2013.01); *E05B 73/0011* (2013.01)

(58) Field of Classification Search

CPC .. E05B 37/0058; E05B 37/0068; E05B 37/02; E05B 37/025; E05B 67/003; E05B 67/006; E05B 73/0005; E05B 73/0011

See application file for complete search history.

(56) References Cited

U.S. PATENT DOCUMENTS 3,611,760 A * 10/1971 Muther ..... E05B 37/025 70/18
3,906,758 A * 9/1975 Hurwitt ..... E05B 73/0011 70/30
4,543,806 A * 10/1985 Papandrea ..... E05B 67/006 70/30
4,896,517 A 1/1990 Ling
5,156,028 A * 10/1992 Jiang ..... E05B 67/006 70/18
5,832,752 A * 11/1998 Zeller ..... E05B 67/006 70/30

(Continued)

*Primary Examiner* — Christopher J Boswell

(74) *Attorney, Agent, or Firm* — Ware, Fressola, Maguire & Barber LLP

(57) ABSTRACT

A cable lock has lock body, a cable and a wheel. The first end of the cable can be securely latched to the lock body and the second end is securely attached to the wheel so that the cable can be retracted into the lock body when the lock is in the open mode. The lock has a plurality of clutches and a plurality of dials to control the rotational movement of the clutches. The dials and clutches form a combination mechanism to control the locking and the unlocking of the lock using a combination code. When the setting of the dials matches the combination code, a release button can be used to release the first end of the cable from the lock body. The lock also has a retract button to enable the retraction of the cable, and a reset button to disengage the dials from the clutches.

10 Claims, 16 Drawing Sheets

(56) References Cited

U.S. PATENT DOCUMENTS

| | | | | |
|---|---|---|---|---|
| 6,470,718 | B1 * | 10/2002 | Yang | E05B 67/003 70/25 |
| 6,681,603 | B1 * | 1/2004 | Yu | E05B 67/006 70/18 |
| 2005/0016232 | A1 * | 1/2005 | Baloga | E05B 73/0011 70/286 |
| 2008/0314094 | A1 * | 12/2008 | Shu | E05B 67/006 70/30 |
| 2013/0305790 | A1 * | 11/2013 | Seele | E05B 73/0011 70/58 |
| 2021/0131146 | A1 * | 5/2021 | Kuchler | E05B 73/0011 |

* cited by examiner

B-B 14B-14B 15A-15A 15B-15B 16A-16A 16B-16B 17A-17A 17B-17B

RETRACTABLE CABLE LOCK WITH IMPROVED RESET MECHANISM

CROSS REFERENCE TO RELATED APPLICATIONS

This application claims priority to U.S. Provisional Application No. 62/788,358, filed Jan. 4, 2019, and U.S. Provisional Application No. 62/791,206, filed Jan. 11, 2019, whose contents are hereby incorporated by reference in their entirety.

TECHNICAL FIELD

The present invention relates generally to a combination lock and, more specifically, to a combination lock having a retractable cable.

BACKGROUND OF THE INVENTION

A cable lock is also known as a wire lock. Instead of having a shackle, a cable lock has a cable which is retractable into the lock body by a take-up unit or a wheel when the lock is operated in the open mode. One end of the cable is securely attached to the wheel so that it can be rewound by the wheel under a spring action. The other end of the cable is brought into engagement of the lock body for locking so that it can be disengaged from the lock body for unlocking. The locking and unlocking of the lock is controlled by a combination mechanism. In general, the combination mechanism comprises a plurality of clutches and a plurality of dials. Each dial has a plurality of indicia to form a combination code. The dials are engageable with the clutches for controlling the rotational movement of the clutches when the lock is operated in the locked mode. When the lock is operated in the open mode, the clutches can be disengaged from the dials so as to allow a user to change the combination code.

SUMMARY OF THE INVENTION

The cable lock according to the present invention has a lock body, a cable and a wheel. The first end of the cable can be securely latched to the lock body and the second end is securely attached to the wheel so that the cable can be retracted into the lock body when the lock is in the open mode. The lock has a plurality of clutches and a plurality of dials to control the rotational movement of the clutches. The dials and clutches form a combination mechanism to control the locking and the unlocking of the lock using a combination code. When the setting of the dials matches the combination code, a release button can be used to release the first end of the cable from the lock body. The lock also has a retract button to enable the retraction of the cable, and a reset button to disengage the dials from the clutches.

Thus, it is an aspect of the present invention to provide a lock operable in a locked mode and in an open mode. The lock comprises:

a cable;

a lock body having a terminal-end hole and a cable channel spaced from the terminal-end hole, the cable channel dimensioned to receive the cable; and a wheel rotatable relative to the lock body, wherein the cable comprises a first end and an opposing second end, the first cable end securely attached to a terminal end, the terminal end engageable with the terminal-end hole, the second cable end securely attached to the wheel, and wherein when the lock is operated in the locked mode, the terminal end of the cable is securely latched in the terminal-end hole, and when the lock is operated in the open mode, the cable is retractable by the wheel into the lock body through the cable channel, with the terminal end of the cable partially positioned in the cable channel, the cable lock further comprising:

a plurality of clutches forming a clutch stack;

a plurality of dials, each dial having a plurality of indicia for forming a combination code, wherein when the lock is operated in the locked mode, the clutches are engaged with the dials, preventing the dials from turning relative to the clutches; and a reset mechanism comprising a contact end positioned in relationship to the clutch stack, wherein when the lock is operated in the open mode, the reset mechanism can be moved relative to the terminal end of the cable positioned in the cable channel to cause the contact end to move the clutch stack in order to disengage the clutches from the dials, allowing the dials to turn independently of the clutches to change the combination code.

According to an embodiment of the present invention, the reset mechanism comprises a reset button, a tube member and a retract button, the reset button comprising a button edge with an arm, the reset button locatable in a first button position and a second button position, the tube member positioned between the button edge of the reset button and the clutch stack to provide the contact end adjacent to the clutch stack, the retract button comprising a pole positioned in relationship to the arm of the reset button, wherein when the reset mechanism is moved to disengage the clutches from the dials, the reset button is moved from the first button position to the second position relative to the terminal end of the cable positioned in the cable channel, and wherein when the reset button is located in the second button position, the arm of the reset button can be rotated to engage with the pole of the retract button, preventing the reset button from moving from the second button position to the first button position.

According to an embodiment of the present invention, the reset mechanism comprises a retract button and a tube member, the retract button comprising a fork having a fork end and a fork channel to allow the cable to pass through, the retract button locatable between a first button position and a second button position, the tube member positioned between the fork end of the retract button and the clutch stack to provide the contact end adjacent to the clutch stack, wherein when the reset mechanism is moved to disengage the clutches from the dials, the retract button is moved from the first button position to the second position relative to the terminal end of the cable positioned in the cable channel.

According to an embodiment of the present invention, the retract button further comprises a cable hole to allow the cable to pass through and a hinge pin positioned in relationship to the fork, and the wheel comprises a plurality of cogs, the lock further comprising a hinge having a hinge hole and a hinge tooth engageable with the cogs, the hinge pin of the retract button movably engaged with the hinge hole of the hinge to control position of the hinge tooth in relationship to the cogs, wherein when the retract button is located in the first button position, the hinge tooth is engaged with the cogs of the wheel, preventing the wheel from rotation relative to the lock body, and when the retract button is located in the second button position, the tooth of the hinge is spaced from the cogs of the wheel, allowing the wheel to rotate relative to the lock body.

According to an embodiment of the present invention, the wheel comprises a plurality of cogs, and the retract button further comprises a cable hole to allow the cable to pass through and a hinge pin positioned in relationship to the cable hole, the retract button locatable between a first retract position and a second retract position, the lock further comprising a hinge having a hinge hole and a hinge tooth engageable with the cogs, the hinge pin of the retract button movably engaged with the hinge hole of the hinge to control position of the hinge tooth in relationship to the cogs, wherein when the retract button is located in the first retract position, the hinge tooth is engaged with the cogs of the wheel, preventing the wheel from rotation relative to the lock body, and when the retract button is located in the second retract position, the hinge tooth is spaced from the cogs of the wheel, allowing the wheel to rotate relative to the lock body.

According to an embodiment of the present invention, the terminal end of the cable comprises a neck, the lock further comprising a release button locatable in a first release position and a second release position, the release button comprising a locking edge positioned in relationship to the terminal-end hole, wherein when the lock is operated in the locked mode, the release button is located in the first release position and the locking edge of the release button is engaged with the neck of the terminal end, preventing the terminal end of the cable from being released from the terminal-end hole of the lock body, and when the lock is operated in the open mode, the release button can be moved from the first release position to the second release position, allowing the terminal end of the cable to be released from the terminal-end hole of the lock body.

According to an embodiment of the present invention, the lock further comprises a release button locatable in a first release position and a second release position, the release button comprising a locking edge and a cylindrical body, the locking edge positioned in relationship to the terminal-end hole, the cylindrical body comprising a plurality of release protrusions, wherein the terminal end of the cable comprises a neck, and each of the clutches comprises an inner opening and an opening slot made in the inner opening, the inner opening dimensioned to receive the cylindrical body of the release button, the opening slot associated with a release protrusion, wherein when the lock is operated in the locked mode and the dials are turned to match the combination code, the opening slot of each of the clutches is aligned with the associated release protrusion, allowing the release button to move from the first release position to the second release position to disengage the terminal end of the cable from the terminal-end hole.

According to an embodiment of the present invention, the lock further comprises a locking pole having a top end, a bottom end and a locking-pole spring positioned in relationship to the bottom end, the locking pole locatable in a first pole position and a second pole position, wherein the retract button further comprises a locking edge positioned in relationship to the bottom end of the locking pole, and wherein when the lock is operated in the locked mode, the locking pole is located in the first pole position and the bottom end of the locking pole is located adjacent to the locking edge of the retract button, preventing the retract button from moving from the first retract position to the second retract position.

According to an embodiment of the present invention, when the terminal end of the cable is removed from the terminal-end hole, the locking-pole spring is arranged to urge the locking pole to move from the first pole position to the second pole position so that the bottom end of the locking pole is spaced from the locking edge of the retract button, allowing the retract button to move from the first retract position to the second retract position.

According to an embodiment of the present invention, the lock further comprises a locking-edge spring arranged to provide an urging force to move the retract button from the second retract position to the first position.

According to an embodiment of the present invention, when the reset button is located in the second button position, the release protrusions of the cylindrical body are received into the opening slots of the clutches, preventing the clutches from rotating relative to the lock body.

DETAILED DESCRIPTION

Figure 1A:
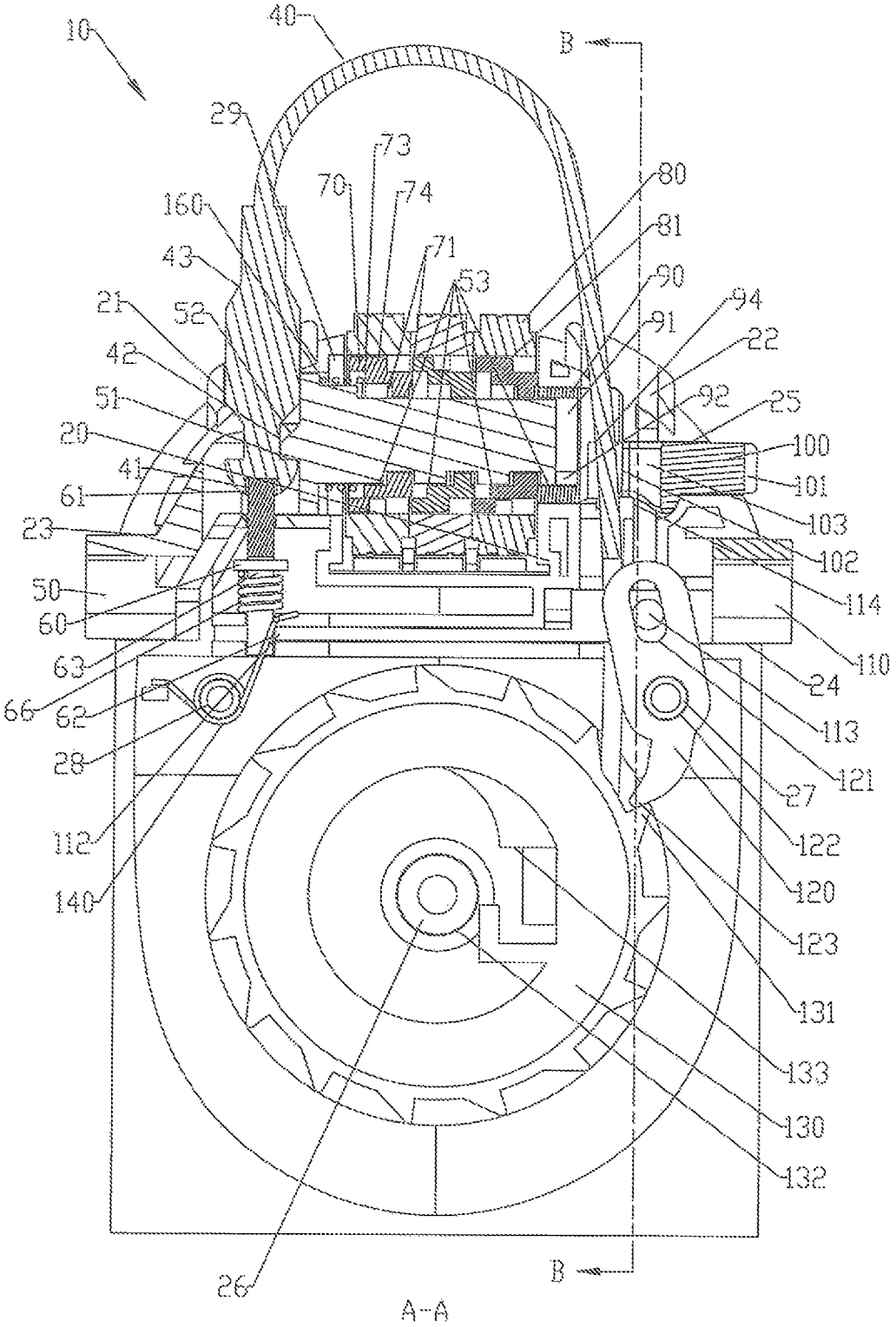
FIG. 1A is a cross-sectional view of a retractable cable lock according to an embodiment of the present invention taken along line A-A of FIG. 1B.
Figure 1B:
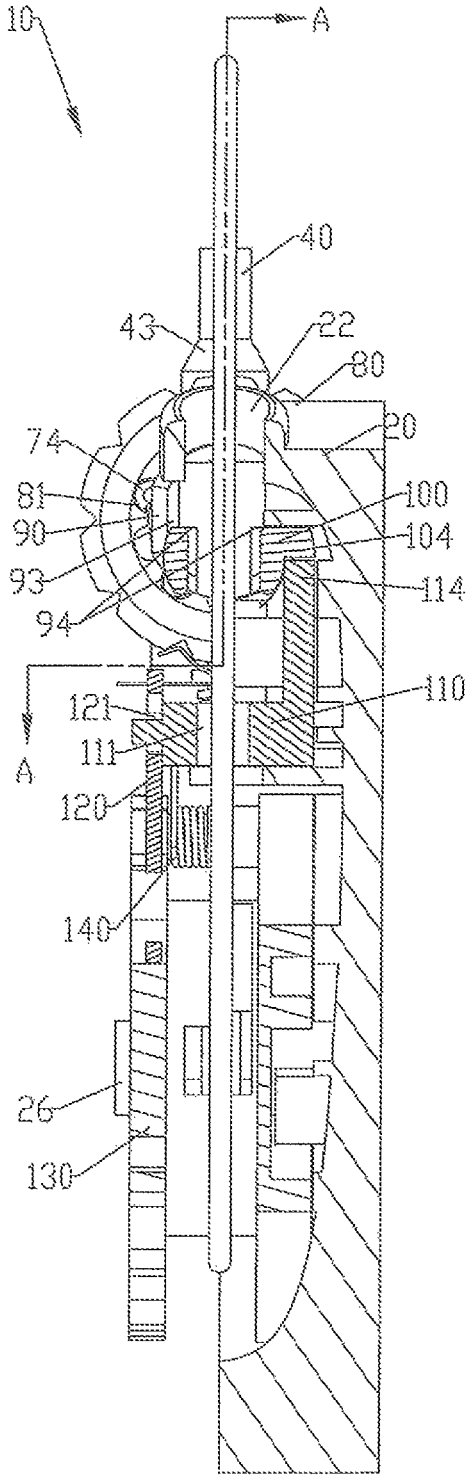
FIG. 1B is a cross-sectional view of the retractable cable lock taken along line B-B of FIG. 1A.

A cable lock is a combination lock having a retractable cable, instead of a shackle. As can be seen in FIGS. 1A-1B, 14A-14B, 15A-15B, the cable lock 10, according to an embodiment of the present invention, has a lock body 20 with a terminal-end hole 21 and a cable channel 22 spaced from the terminal-end hole 21. The cable lock 10 also has a wheel 130 positioned in the lock body 20, rotatable relative to the lock body 20 and a cable 40 having one end securely attached to a terminal end 43 and another end securely attached to the wheel 130 so that when the cable lock 10 is operated in the open mode, a part of the cable 40 can be retracted through the cable channel 22 into the lock body 20 by the wheel 130. According to an embodiment of the present invention, the terminal end 43 of the cable 40 has a neck 42 and a recess 41. The cable lock 10 has a release button 50 having a locking edge 51 engageable with the neck 42, and a locking pole 60 having a top end 61 engageable with the recess 41 of the terminal end 43. The top end 61 of the locking pole 60 is arranged to be received into the recess 41 so that the locking pole 60 can be pushed downward to a downward position by the terminal end 43 of the cable 40 until the locking edge 51 is latched into the neck 42 to operate the cable lock 10 in the locked mode. As such, part of the cable 40 forms a cable loop between the cable channel 22 and the terminal-end hole 21. The cable lock 10 has a retract button 110 arranged to control the rotational movement of the wheel 130. As a combination lock, the cable lock 10 has a combination mechanism formed by a plurality of clutches 70 and a plurality of dials 80. The clutches 70 are placed together to form a clutch stack. Each of the clutches 70 has one or more clutch protrusions 74, and each of the dials 80 has a plurality of dial slots 81 dimensioned to receive the clutch protrusions 74. With the dial slots 81 and the clutch protrusions 74, the dials 80 are engageable with the clutch stack to control the rotational movement of the clutches 70. Each of the dials 80 has a plurality of indicia to form a combination code. When the dials 80 are turned to match the combination code, the clutch stack can be disengaged from the dials 80 to unlock the cable lock 10.

Figure 2:
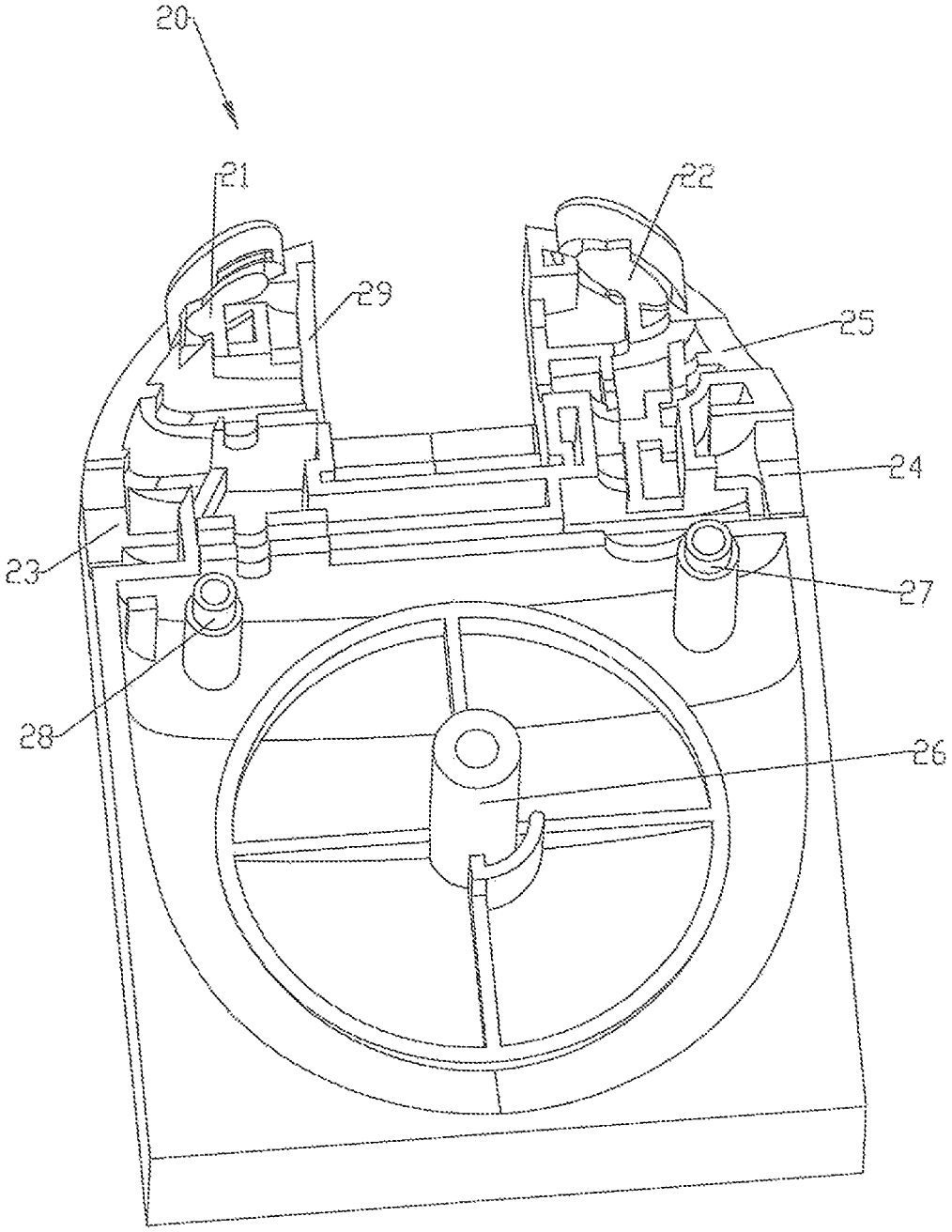
FIG. 2 is a perspective view of a portion of the body.
Figure 3:
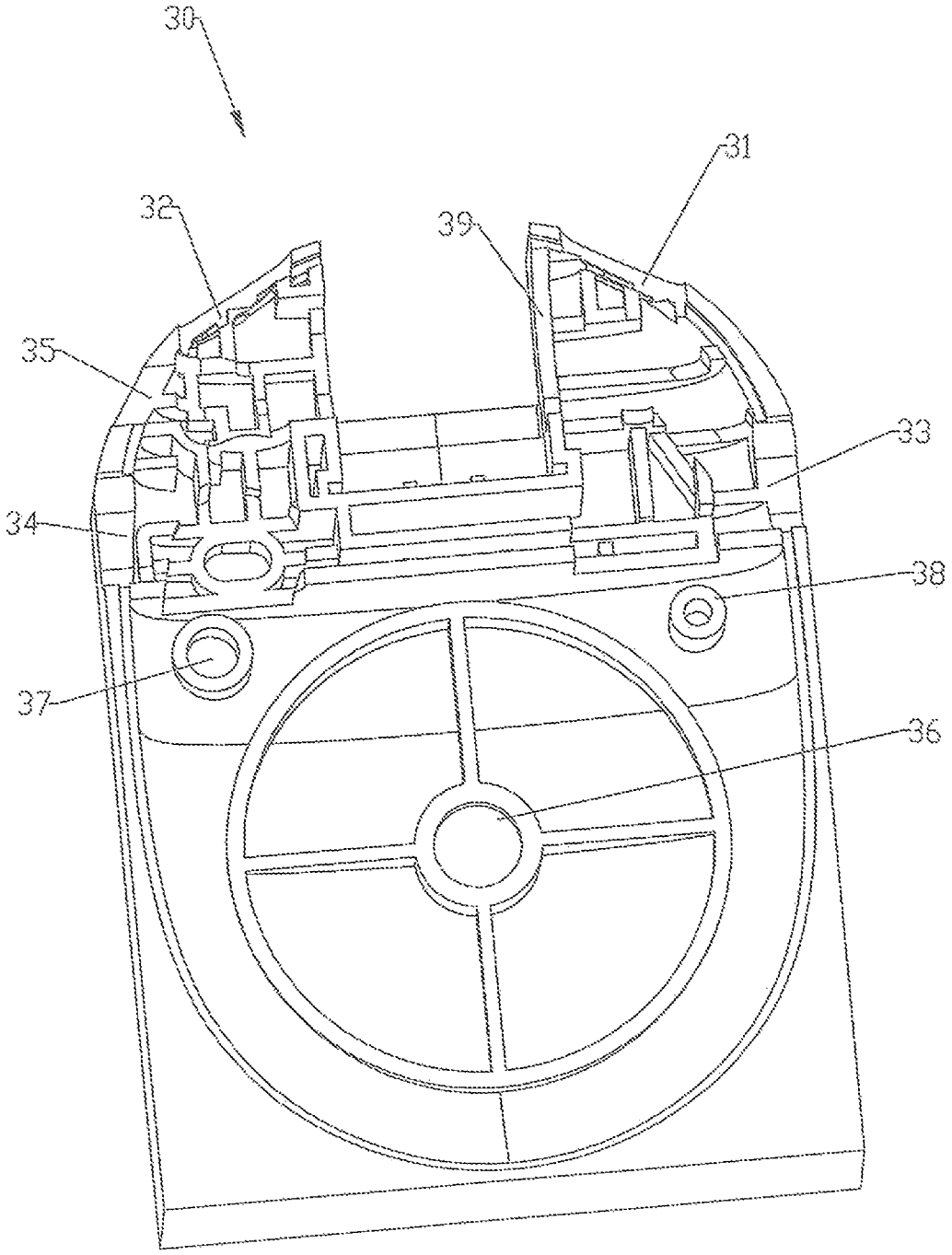
FIG. 3 is a perspective view of the mating portion of the body.
Figure 4:
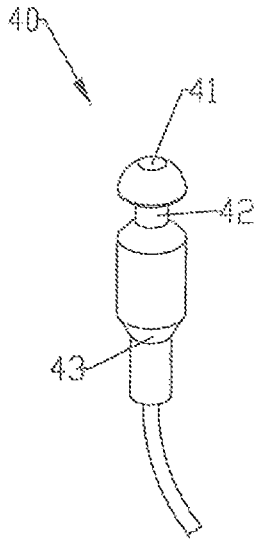
FIG. 4 is a perspective view of the cable.
Figure 5:
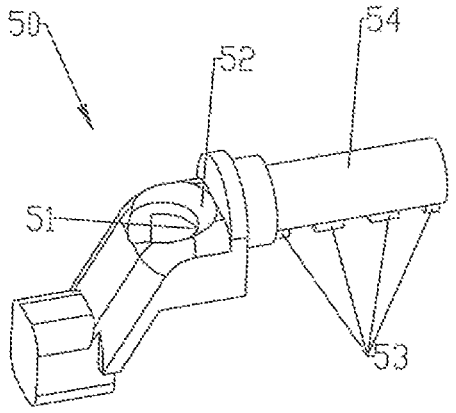
FIG. 5 is a perspective view of the release button.
Figure 6:
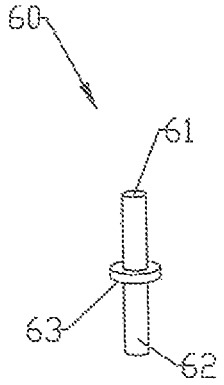
FIG. 6 is a perspective view of the locking-pole.
Figure 7A:
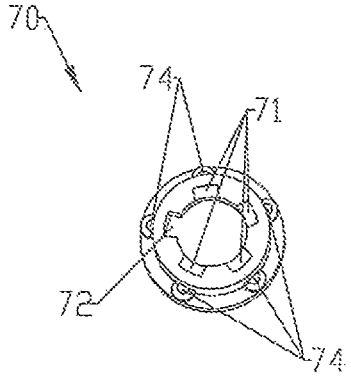
FIG. 7A is a perspective view of the clutch.
Figure 7B:
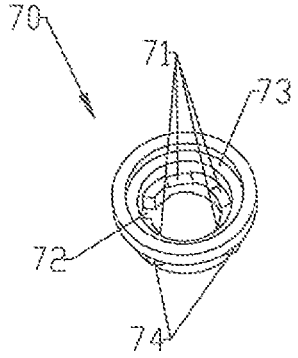
FIG. 7B is another perspective view of the clutch.
Figure 8:
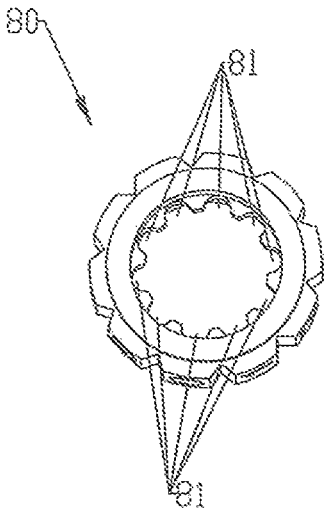
FIG. 8 is a perspective view of the dial.
Figure 9A:
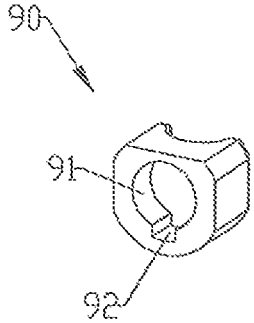
FIG. 9A is a perspective view of the tube member.
Figure 9B:
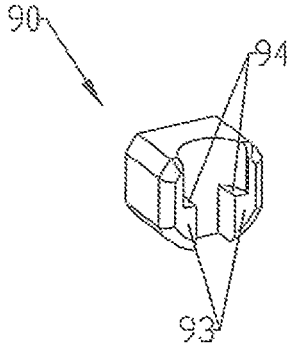
FIG. 9B is another perspective view of the tube member.

The lock body 20 is made up of two mating portions as shown in FIGS. 2 and 3. The lock body 20 has a release-button hole 23/33 to receive the release button 50, a retract-button hole 24/24 to receive a retract button 110, a reset-button hole 25/35 to receive a rest-button 100, a cable-wheel pole 26/36 to receive a wheel-hinge hole 132 of the wheel 130. The outer perimeter of the wheel 130 has a plurality of cogs 131 which are arranged to engage with a tooth 123 of a hinge 120 when the cable lock 10 is operated in the locked mode. The hinge 120 has a hinge hole 122 pivotable about a hinge pole 27 of the lock body 20, and a hinge opening 121 movably engaged with a hinge pole 113 of the retract button 110.

The cable lock 10 has a reset button 100 which can only be used to reset the combination code when the cable lock 10 is operated in the open mode.

Locked Mode (FIGS. 1A-13B):

When the cable lock 10 is operated in the locked mode, the terminal end 43 of the cable 40 is securely latched in the terminal-end hole 21 of the lock body 20 as the locking edge 51 is latched into the neck 42 of the terminal end 43. The clutch stack is arranged to prevent the release button 50 from an inward movement relative to the lock body 20 in order to disengage the locking edge 51 of the release button 50 from the neck 42. Furthermore, the locking pole 60 has a bottom end 62. When the cable lock 10 is operated in the locked mode, the locking pole 60 is in the downward position and the bottom end 62 of the locking pole 60 prevents the retract button 100 from being pushed inward to release the tooth 123 of the hinge 120 from the cogs 131 of the wheel 130 so as to allow the cable loop of the cable 40 between the terminal-end hole 21 and the cable channel 22 to be adjusted. The cable loop can only be adjusted by a user prior to pushing the terminal end 43 of the cable 40 into the terminal-end hole 21 to the locked position.

Unlock by Combination (FIG. 14A-14B):

According to an embodiment of the present invention, the release button 50 has a cylindrical body 54 engageable with the clutch stack. The cylindrical body 54 has a plurality of release protrusions 53 and each of the clutches 70 has an opening slot 72 positioned in relationship with a release protrusion 53. When a clutch 70 is rotated together with the associated dial 80, a clicking sound may occur when the release protrusion 53 is rubbed against the opening slot 72. In order to prevent the lock from being picked using the clicking sound, each clutch 70 also has a plurality of false gates 71 arranged to produce a similar click sound when the release protrusion 53 is rubbed against a false gate 71.

Figure 14A:
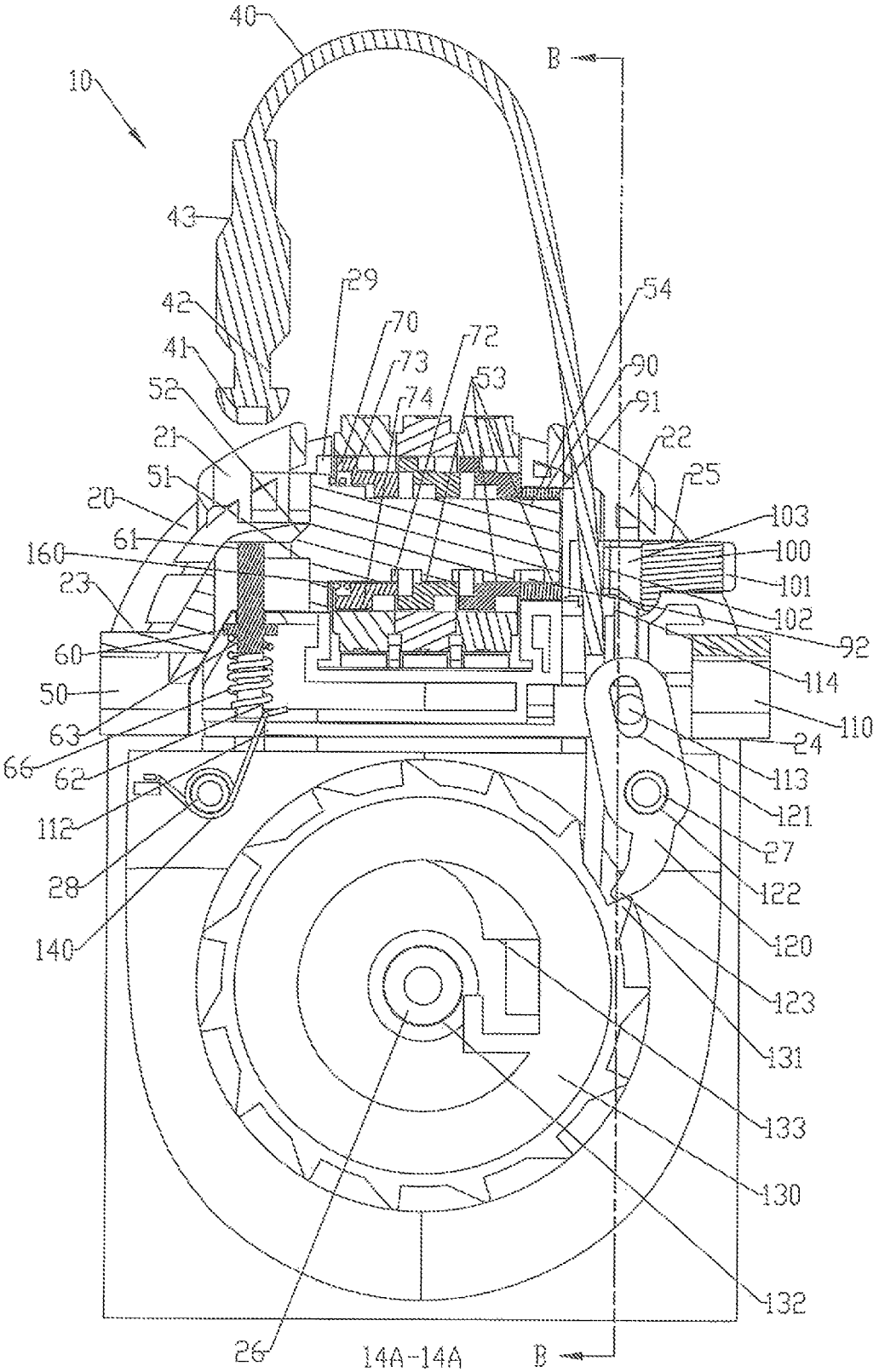
FIG. 14A is a cross-sectional view of the retractable cable lock taken along line A-A of FIG. 14B.
Figure 14B:
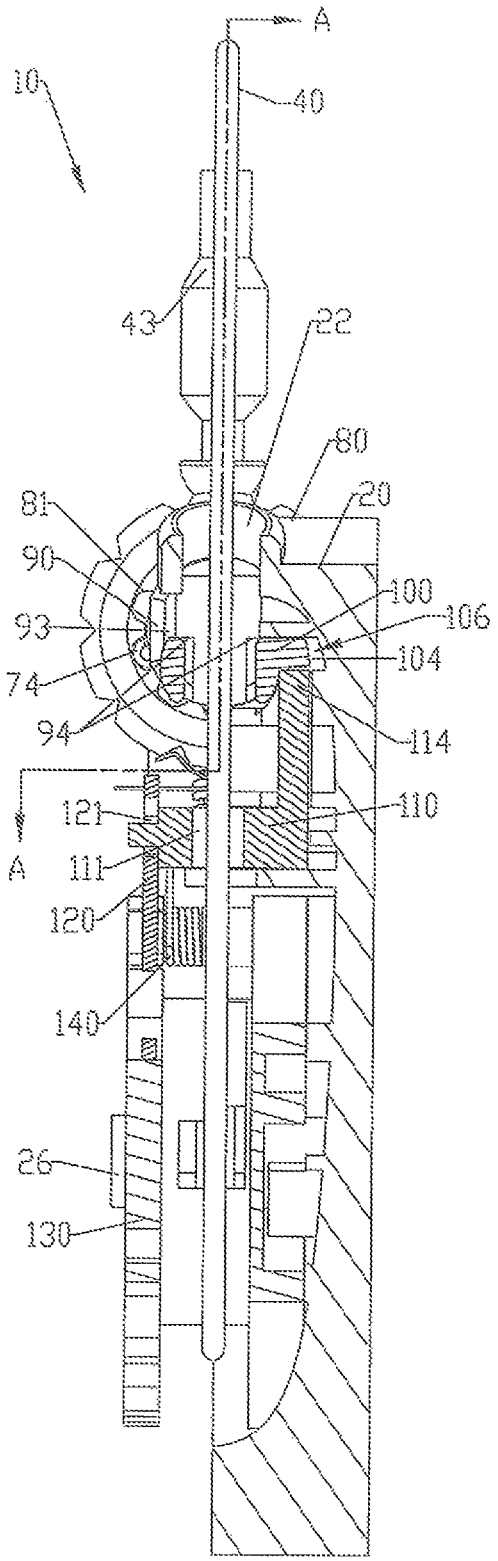
FIG. 14B is a cross-sectional view of the retractable cable lock taken along line B-B of FIG. 14A.

When the setting of the dials 80 matches the combination code, the opening slots 72 of the clutches 70 are aligned with the protrusions 53 of the release button 50. The release button 50 can be pushed inward relative to the clutches 70 to disengage the locking edge 51 of the release button 50 from the neck 42 of terminal end 43. A spring 66 mounted on the bottom end 62 below the spring edge 63 of the locking pole 60 is arranged to push the locking pole 60 upward to the upward position and the terminal end 43 of the cable 40 is also pushed away from the terminal-end hole 21 of the lock body 20 as shown in FIGS. 14A and 14B. The cable lock 10 also has a spring 160 arranged to push the release 50 back to its original outward position as shown in FIG. 15A.

Figure 15A:
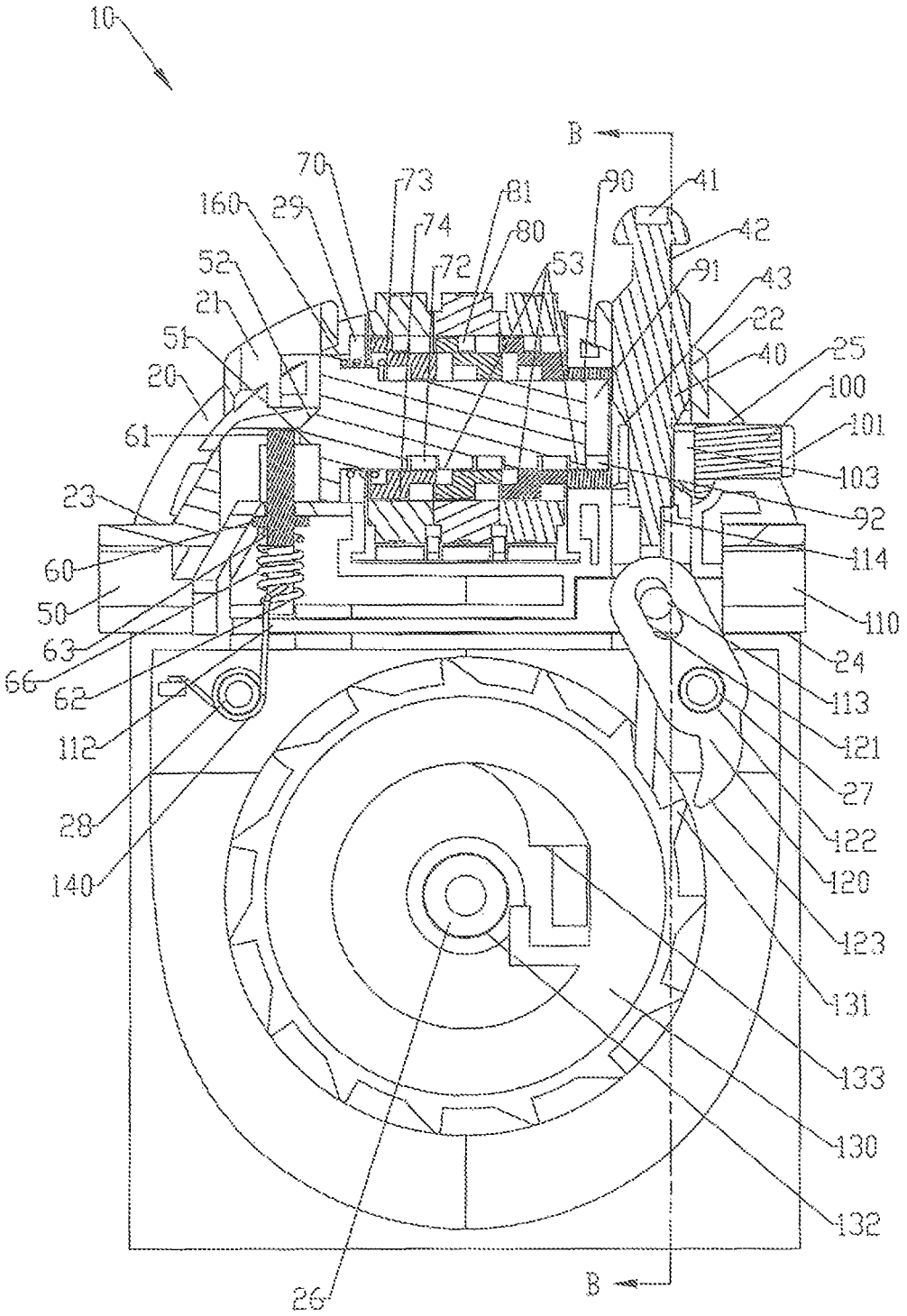
FIG. 15A is a cross-sectional view of the retractable cable lock taken along line A-A of FIG. 15B.
Figure 15B:
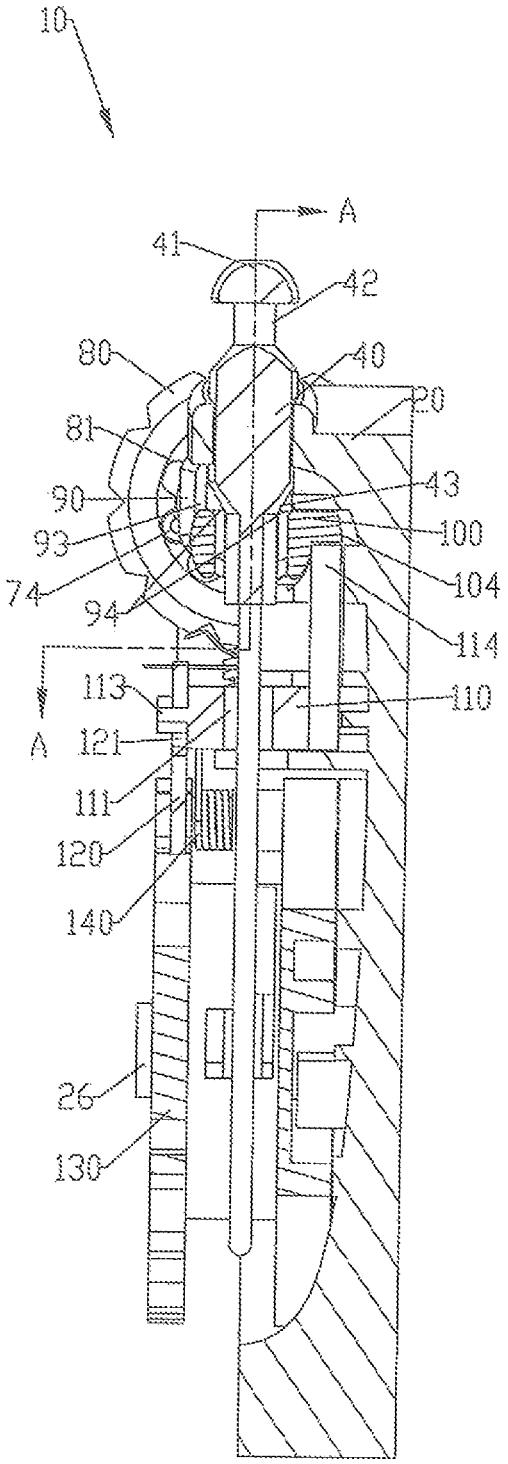
FIG. 15B is cross-sectional view of the retractable cable lock taken along line B-B of FIG. 15A.
Figure 16A:
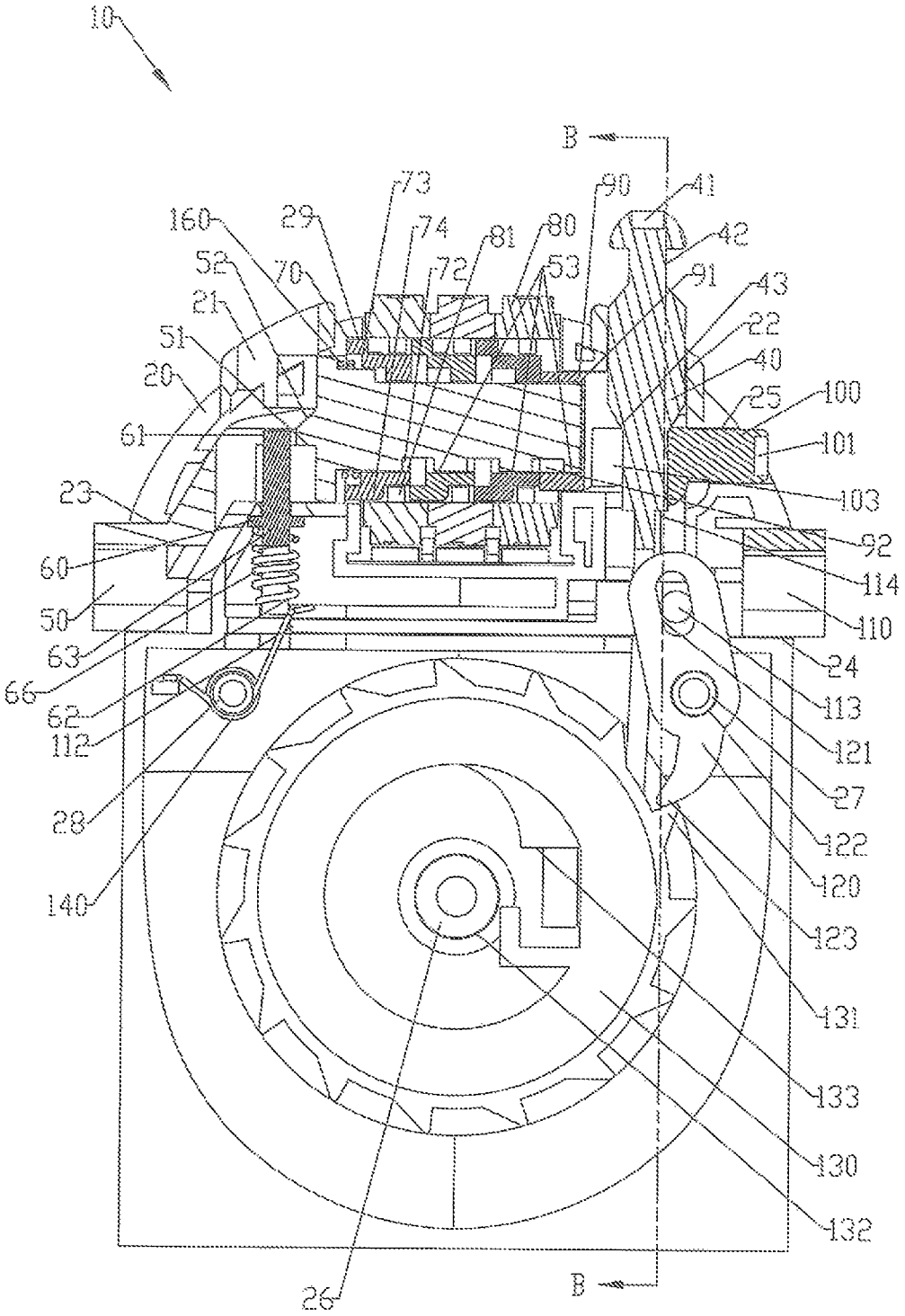
FIG. 16A is a cross-sectional view of the retractable cable lock taken along line B-B of FIG. 16B.
Figure 16B:
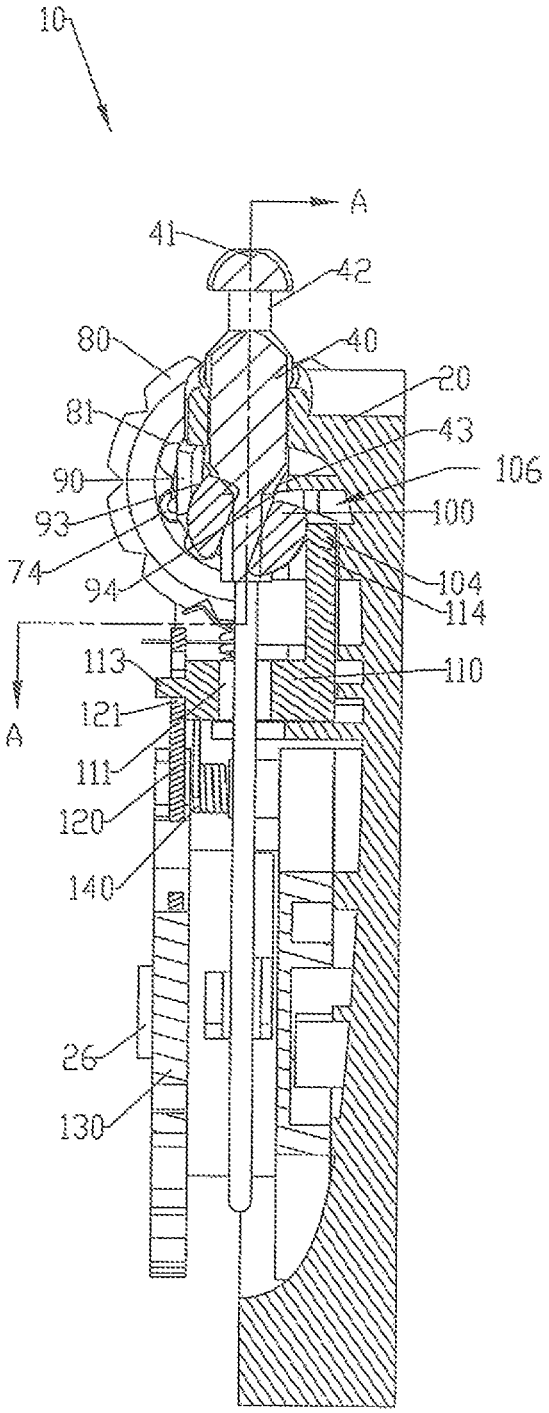
FIG. 16B is a cross-sectional view of the retractable cable lock taken along line A-A of FIG. 16A.

As the locking pole 60 is in the upward position, the retract button 100 can be pushed inward to release the tooth 123 of the hinge 120 from the cogs 131 of the wheel 130 as shown in FIG. 15A. A coil spring placed in the wheel 130 is arranged to rotate the wheel 130 to retract the cable into the lock body 20 until the terminal end 43 of the cable 40 rests on the cable channel 22. The wheel 130 has spring placement areas 133 and 134 (see FIG. 13B) for placing the ends of the coil spring. According to an embodiment of the present invention, a tube member 90 is placed in the lower part of the cable channel 22. The tube member 90 has a stopper area 94 arranged to keep the terminal-end 43 of the cable 40 in place as shown in FIG. 15B. Once the retract button 100 is released, a spring 140 is arranged to push the retract button 100 back to the outward position as shown in FIG. 16A.

Reset Mode (FIGS. 1B, 10, 11, 14B, 15B, 16A-16B and 18):

When the cable lock 10 is operated in the open mode, each of the protrusions 53 of the release button 50 is aligned with the opening slot 72 of the associated clutch 70, and the clutch stack can be pushed toward the terminal-end hole 21 of the lock body 20 so as to disengage the clutches 70 from the dials 80. As such, the user can turn the dials 80 independently of the clutches 70 to set a new combination code.

In an embodiment of the present invention, when the reset button 100 is pushed inward, the fork end 102 (see FIG. 10) of the reset button 100 is arranged to contact the edge 93 of the tube member 90 so that the tube member 90 further pushes the clutches 70 toward the terminal-end hole 21 of the lock body 20. As such, the protrusions 53 of the release button 50 are received into the opening slots 72 of the clutches 70, preventing the clutches 70 from rotational movement relative to the lock body 20. As the dials are also disengaged from the clutches 70, the user can turn the dials to set a new combination code.

Figure 10:
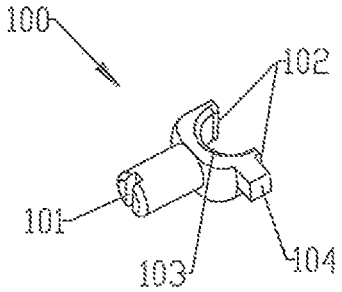
FIG. 10 is a perspective view of the reset button.
Figure 11:
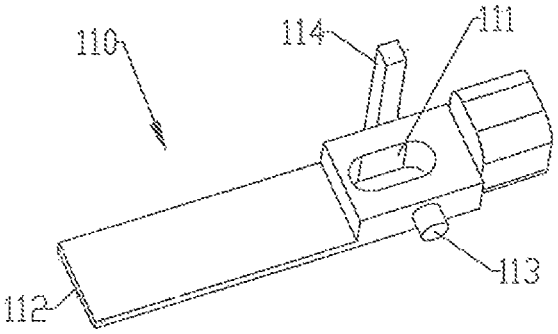
FIG. 11 is a perspective view of the retract button.
Figure 12:
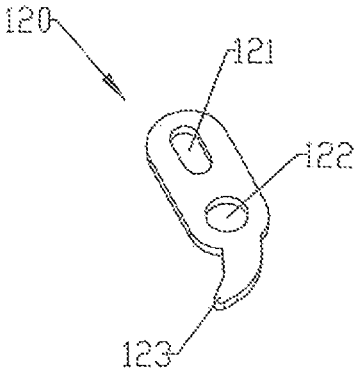
FIG. 12 is a perspective view of the hinge.
Figure 13A:
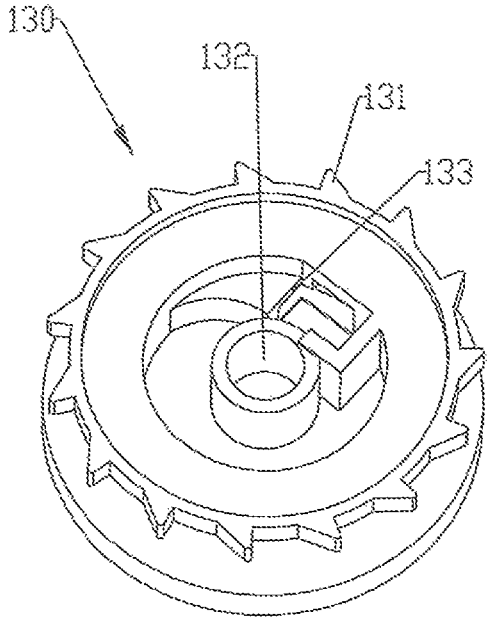
FIG. 13A is a perspective view of the wheel.
Figure 13B:
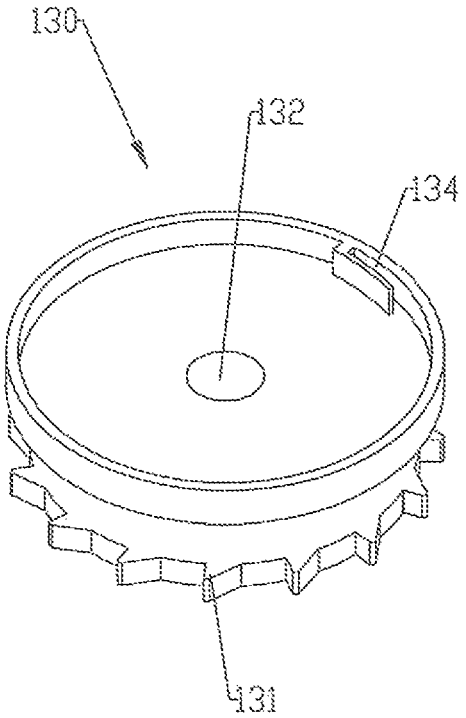
FIG. 13B is another perspective view of the wheel.

As seen in FIG. 11, the retract button 110 has a cable hole 111, a locking edge 112, a hinge hole 113 and a pole 114. The cable hole 111 allows the cable 40 to pass through as the cable 10 is retracted into the lock body 20 by the wheel 130 or lengthened. The locking edge 112 is positioned in relationship to the bottom end 62 of the locking pole 60 to prevent the retract button from being pushed inward when the cable lock 10 is operated in the locked mode. The hinge pole 113 is movably engaged with the hinge hole 121 of the hinge 120 to control the position of the tooth 123. The pole 114 is arranged to keep the reset button in place after the reset button is pushed inward for resetting purposes. As seen in FIG. 10, the reset button 100 has an arm 104 and a cable hole 103 to accommodate the cable 40. When the reset button 100 is pushed inward to release the clutches 70 from the dials 80, the arm 104 of the reset button can rotate to a predetermined angle by turning the slot 101 of reset button 100. The arm 104 travels inside a trench region 106 of the lock body 20 to be engaged with the pole 114 of the retract button 110 as shown in FIGS. 14B, 16B, 17B and 18. As such, the reset-button is kept in the inward position without the need for being pushed by the user. The user can have both hands free for rotating the dials to set a new combination code. After setting the new code, the user counter-rotates the arm 104 of the reset button 100 to release the arm 104 from the pole 114 of the retract button 110. The spring action of spring 160 is arranged to push the clutch stack and the reset button 100 back to their earlier positions so that the clutches 70 are engaged with the dials 80. It should be noted that if the user forgets to counter-rotate the arm 104 of the reset button 100, the engagement of the arm 104 of the reset button 100 and the pole 114 of the retract button 110 prevents the retract button from moving inward to retract the cable 40.

Figure 17A:
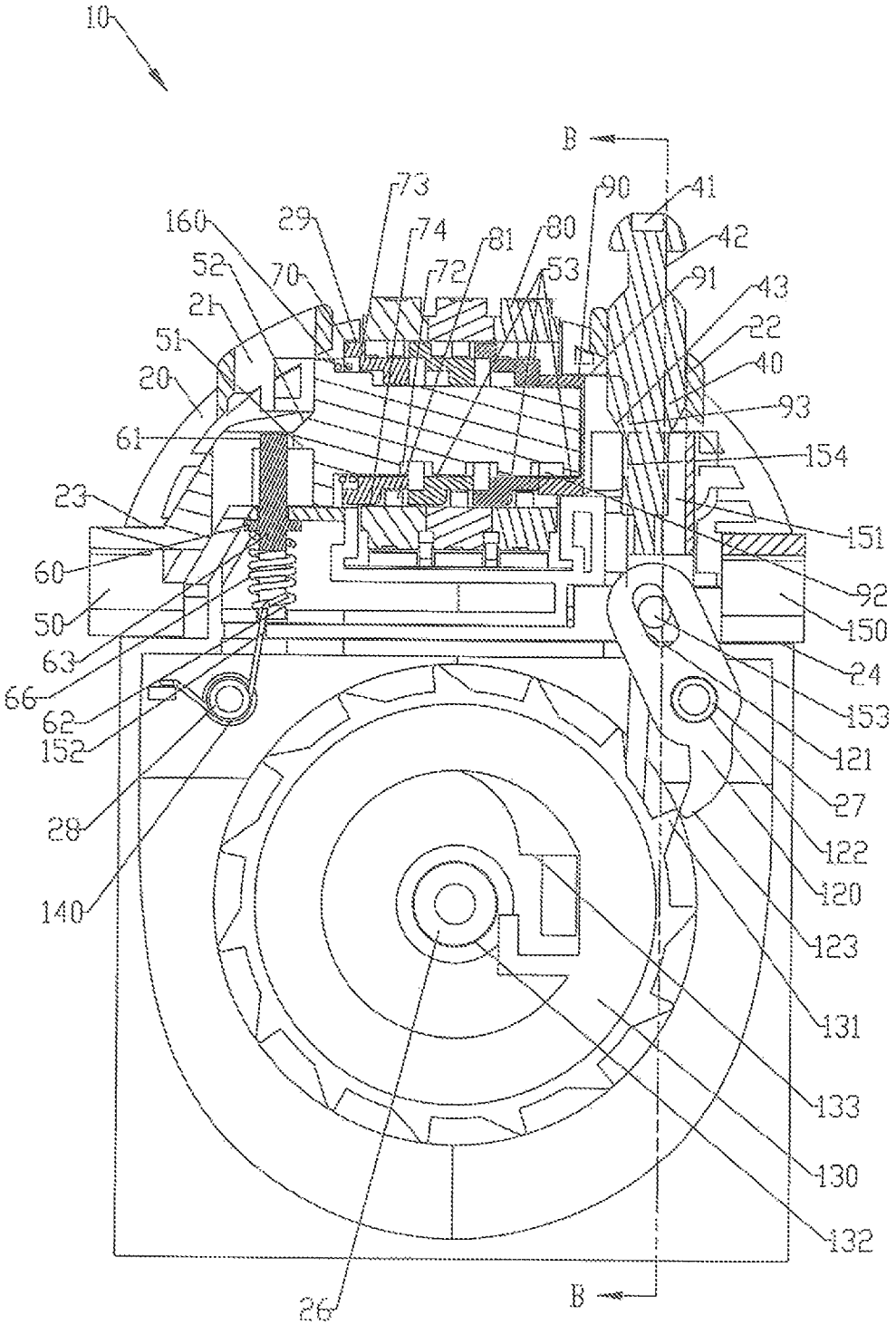
FIG. 17A is a cross-sectional view of a second embodiment of the retractable cable lock taken along line A-A of FIG. 17B.
Figure 17B:
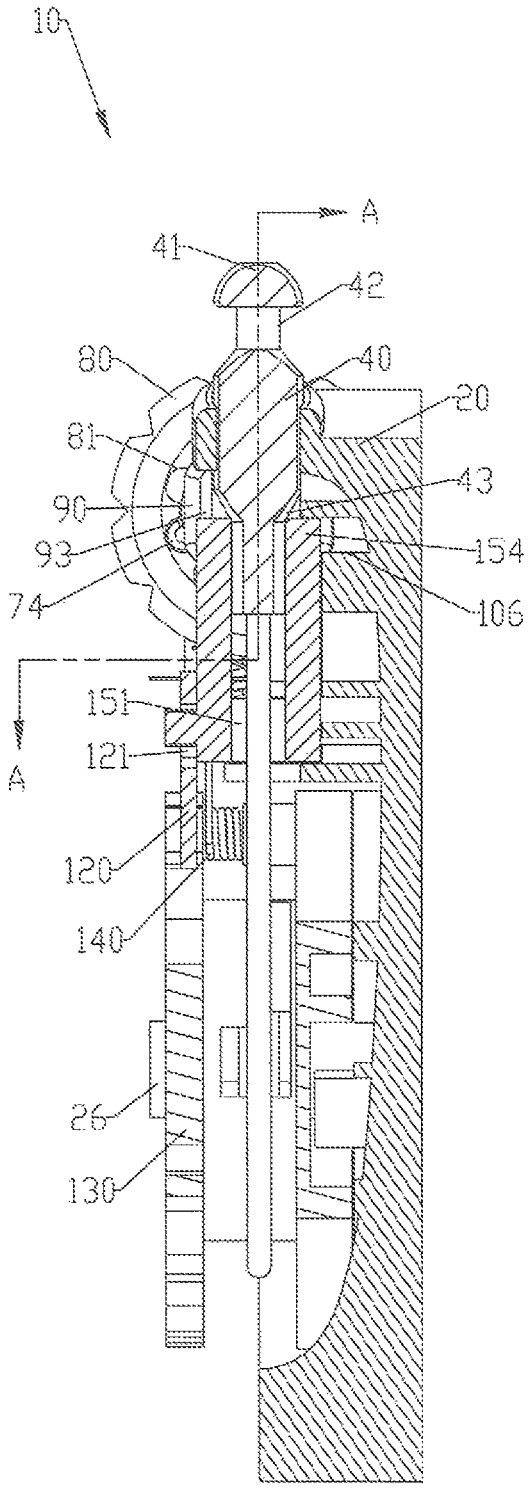
FIG. 17B is a cross-sectional view of a second embodiment of the retractable cable lock taken along line B-B of FIG. 17A.
Figure 17C:
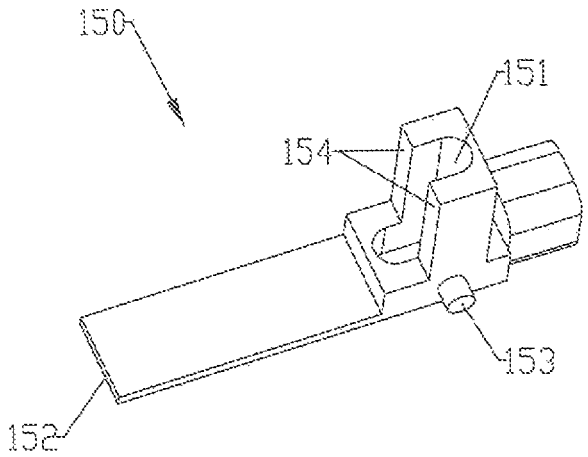
FIG. 17C is a perspective view of the retract/reset button as shown in FIGS. 17A and 17B.
Figure 18:
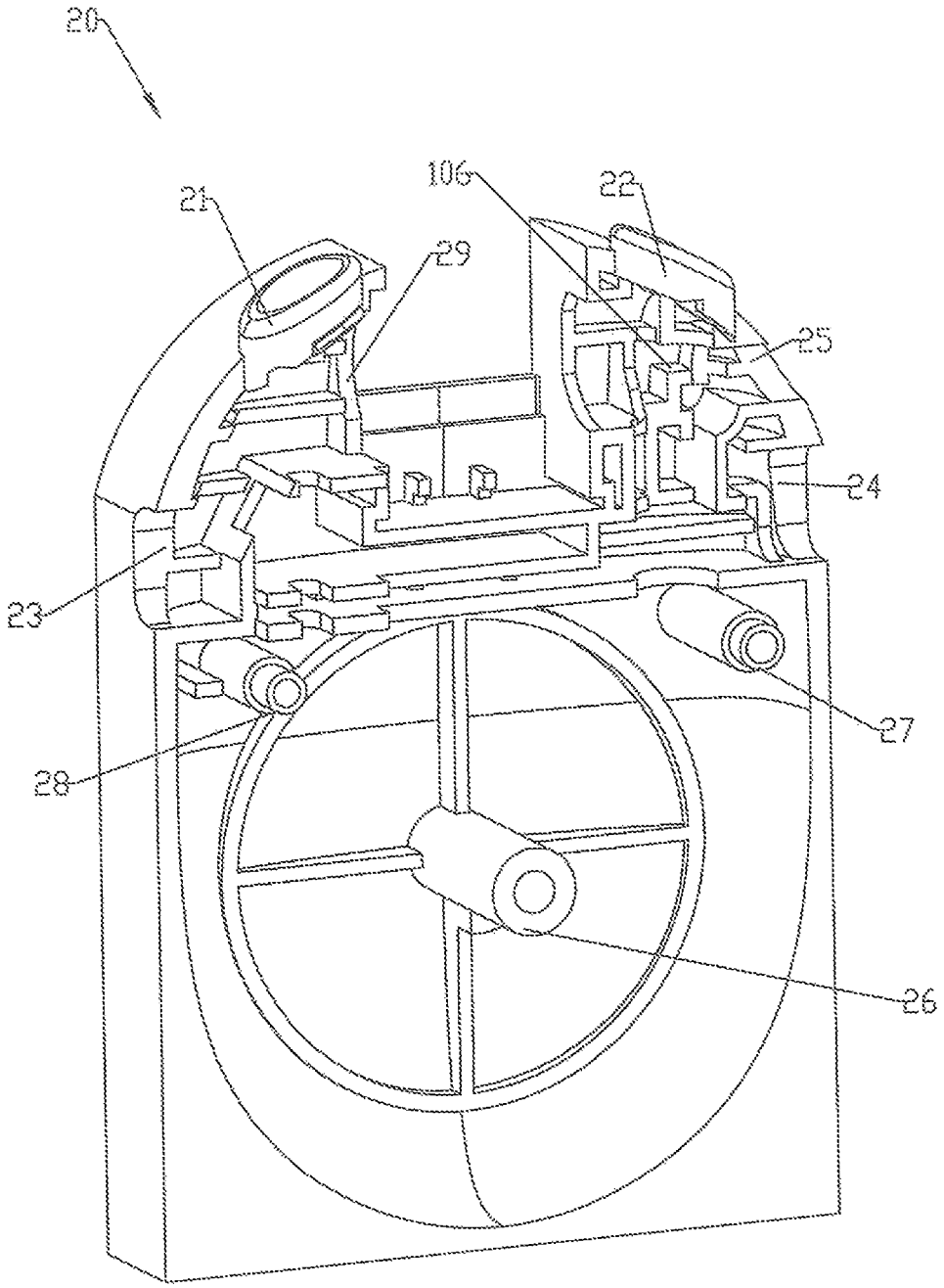
FIG. 18 is a perspective view of the portion of the body shown in FIG. 2, showing this portion of the body from a left side perspective so as to better illustrate a trench region of this body portion.

Second Embodiment (FIG. 17A-17C)

According to another embodiment of the present invention, the features of the retract button 110 and the reset button 100 are combined in a retract/reset button 150. As shown in FIG. 17C, the retract/reset button 150 has hinge pin 153, a cable hole 151, a locking edge 152 and a fork end 154. As with the retract button 110, the cable hole 151 allows the cable 40 to pass through as the cable 10 is retracted into the lock body 20 by the wheel 130 or lengthened. The locking edge 152 is positioned in relationship to the bottom end 62 of the locking pole 60 to prevent the retract/reset button 150 from being pushed inward when the cable lock 10 is operated in the locked mode. The hinge pin 153 is movably engaged with the hinge hole 121 of the hinge 120 to control the position of the tooth 123.

When the cable lock 10 is operated in the open mode, the user can push the retract/reset button 150 inward and hold the button in place. The fork-end 154 is arranged to contact the edge 93 of the tube-member 90 so that the tube member 90 further pushes the clutches 70 toward the terminal-end hole 21 of the lock body 20. As such, the protrusions 53 of the release button 50 are received into the opening slots of the clutches 70 while the dials 80 are disengaged from the clutches 80 to allow the user to set a new combination code.

In summary, the cable lock, according to an embodiment of the present invention has a cable; a lock body having a terminal-end hole and a cable channel spaced from the terminal-end hole, the cable channel dimensioned to receive the cable; and a wheel rotatable relative to the lock body, wherein the cable comprises a first end and an opposing second end, the first cable end securely attached to a terminal end, the terminal end engageable with the terminal-end hole, the second cable end securely attached to the wheel, and wherein when the lock is operated in the locked mode, the terminal end of the cable is securely latched in the terminal-end hole, and when the lock is operated in the open mode, the cable is retractable by the wheel into the lock body through the cable channel, with the terminal end of the cable partially positioned in the cable channel. The cable lock also has a plurality of clutches forming a clutch stack; a plurality of dials, each dial having a plurality of indicia for forming a combination code, wherein when the lock is operated in the locked mode, the clutches are engaged with the dials, preventing the dials from turning relative to the clutches; and a reset mechanism having a contact end positioned in relationship to the clutch stack, wherein when the lock is operated in the open mode, the reset mechanism can be moved relative to the terminal end of the cable positioned in the cable channel to cause the contact end to move the clutch stack in order to disengage the clutches from the dials, allowing the dials to turn independently of the clutches to change the combination code.

The reset mechanism is used to disengage the dials from the clutch stack. The reset mechanism has a contact end positioned in relationship to the clutch stack, wherein when the lock is operated in the open mode, the reset mechanism can be moved relative to the terminal end of the cable positioned in the cable channel to cause the contact end to move the clutch stack in order to disengage the clutches from the dials, allowing the dials to turn independently of the clutches to change the combination code.

In one embodiment, the reset mechanism has a reset button, a tube member and a retract button, the reset button comprising a button edge with an arm, the reset button locatable in a first button position and a second button position, the tube member positioned between the button edge of the reset button and the clutch stack to provide the contact end adjacent to the clutch stack, the retract button comprising a pole positioned in relationship to the arm of the reset button, wherein when the reset mechanism is moved to disengage the clutches from the dials, the reset button is moved from the first button position to the second position relative to the terminal end of the cable positioned in the cable channel, and wherein when the reset button is located in the second button position, the arm of the reset button can be rotated to engage with the pole of the retract button, preventing the reset button from moving from the second button position to the first second button position.

In another embodiment of the present invention, the reset mechanism has a retract button and a tube member, the retract button comprising a fork having a fork end and a fork channel to allow the cable to pass through, the retract button locatable between a first button position and a second button position, the tube member positioned between the fork end of the retract button and the clutch stack to provide the contact end adjacent to the clutch stack, wherein when the reset mechanism is moved to disengage the clutches from the dials, the retract button is moved from the first button position to the second position relative to the terminal end of the cable positioned in the cable channel.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A lock operable in a locked mode and in an open mode, comprising:

a cable;

a lock body having a terminal-end hole and a cable channel spaced from the terminal-end hole, the cable channel dimensioned to receive the cable; and a wheel rotatable relative to the lock body, wherein the cable comprises a first end and an opposing second end, the first cable end securely attached to a terminal end, the terminal end engageable with the terminal-end hole, the second cable end securely attached to the wheel, and wherein when the lock is operated in the locked mode, the terminal end of the cable is securely latched in the terminal-end hole, and when the lock is operated in the open mode, the cable is retractable by the wheel into the lock body through the cable channel, with the terminal end of the cable partially positioned in the cable channel, the cable lock further comprising:

a plurality of clutches forming a clutch stack;

a plurality of dials, each dial having a plurality of indicia for forming a combination code, wherein when the lock is operated in the locked mode, the clutches are engaged with the dials, preventing the dials from turning relative to the clutches; and a reset mechanism comprising a contact end positioned in relationship to the clutch stack, wherein when the lock is operated in the open mode, the reset mechanism can be moved relative to the terminal end of the cable positioned in the cable channel to cause the contact end to move the clutch stack in order to disengage the clutches from the dials, allowing the dials to turn independently of the clutches to change the combination code, wherein the reset mechanism comprises a reset button, a tube member and a retract button, the reset button comprising a button edge with an arm, the reset button locatable in a first button position and a second button position, the tube member positioned between the button edge of the reset button and the clutch stack to provide the contact end adjacent to the clutch stack, the retract button comprising a pole positioned in relationship to the arm of the reset button, wherein when the reset mechanism is moved to disengage the clutches from the dials, the reset button is moved from the first button position to the second position relative to the terminal end of the cable positioned in the cable channel, and wherein when the reset button is located in the second button position, the arm of the reset button can be rotated to engage with the pole of the retract button, preventing the reset button from moving from the second button position to the first button position.

2. The lock according to claim 1, wherein the reset mechanism comprises a retract button and a tube member, the retract button comprising a fork having a fork end and a fork channel to allow the cable to pass through, the retract button locatable between a first button position and a second button position, the tube member positioned between the fork end of the retract button and the clutch stack to provide the contact end adjacent to the clutch stack, wherein when the reset mechanism is moved to disengage the clutches from the dials, the retract button is moved from the first button position to the second position relative to the terminal end of the cable positioned in the cable channel.

3. The lock according to claim 2, wherein the retract button further comprises a cable hole to allow the cable to pass through and a hinge pin positioned in relationship to the fork, and the wheel comprises a plurality of cogs, the lock further comprising a hinge having a hinge hole and a hinge tooth engageable with the cogs, the hinge pin of the retract button movably engaged with the hinge hole of the hinge to control position of the hinge tooth in relationship to the cogs, wherein when the retract button is located in the first button position, the hinge tooth is engaged with the cogs of the wheel, preventing the wheel from rotation relative to the lock body, and when the retract button is located in the second button position, the tooth of the hinge is spaced from the cogs of the wheel, allowing the wheel to rotate relative to the lock body.

4. The lock according to claim 1, wherein the wheel comprises a plurality of cogs, and the retract button further comprises a cable hole to allow the cable to pass through and a hinge pin positioned in relationship to the cable hole, the retract button locatable between a first retract position and a second retract position, the lock further comprising a hinge having a hinge hole and a hinge tooth engageable with the cogs, the hinge pin of the retract button movably engaged with the hinge hole of the hinge to control position of the hinge tooth in relationship to the cogs, wherein when the retract button is located in the first retract position, the hinge tooth is engaged with the cogs of the wheel, preventing the wheel from rotation relative to the lock body, and when the retract button is located in the second retract position, the hinge tooth is spaced from the cogs of the wheel, allowing the wheel to rotate relative to the lock body.

5. The lock according to claim 1, wherein the terminal end of the cable comprises a neck, the lock further comprising a release button locatable in a first release position and a second release position, the release button comprising a locking edge positioned in relationship to the terminal-end hole, wherein when the lock is operated in the locked mode, the release button is located in the first release position and the locking edge of the release button is engaged with the neck of the terminal end, preventing the terminal end of the cable from being released from the terminal-end hole of the lock body, and when the lock is operated in the open mode, the release button can be moved from the first release position to the second release position, allowing the terminal end of the cable to be released from the terminal-end hole of the lock body.

6. The lock according to claim 1, further comprising a release button locatable in a first release position and a second release position, the release button comprising a locking edge and a cylindrical body, the locking edge positioned in relationship to the terminal-end hole, the cylindrical body comprising a plurality of release protrusions, wherein the terminal end of the cable comprises a neck, and each of the clutches comprises an inner opening and an opening slot made into the inner opening, the inner opening dimensioned to receive the cylindrical body of the release button, the opening slot associated with a release protrusion, wherein when the lock is operated in the locked mode and the dials are turned to match the combination code, the opening slot of each of the clutches is aligned with the associated release protrusion, allowing the release button to move from the first release position to the second release position to disengage the terminal end of the cable from the terminal-end hole.

7. The lock according to claim 6, further comprising a locking pole having a top end, a bottom end and a locking-pole spring positioned in relationship to the bottom end, the locking pole locatable in a first pole position and a second pole position, wherein the retract button further comprises a locking edge positioned in relationship to the bottom end of the locking pole, and wherein when the lock is operated in the locked mode, the locking pole is located in the first pole position and the bottom end of the locking pole is located adjacent to the locking edge of the retract button, preventing the retract button from moving from the first retract position to the second retract position.

8. The lock according to claim 7, wherein when the terminal end of the cable is removed from the terminal-end hole, the locking-pole spring is arranged to urge the locking pole to move from the first pole position to the second pole position so that the bottom end of the locking pole is spaced from the locking edge of the retract button, allowing the retract button to move from the first retract position to the second retract position.

9. The lock according to claim 8, further comprising a locking-edge spring arranged to provide an urging force to move the retract button from the second retract position to the first position.

10. The lock according to claim 6, wherein when the reset button is located in the second button position, the release protrusions of the cylindrical body are received into the opening slots of the clutches, preventing the clutches from rotating relative to the lock body.

* * * * *